US005399066A

United States Patent [19]

Ritchie et al.

[11] Patent Number: 5,399,066

[45] Date of Patent: Mar. 21, 1995

[54] INTEGRAL CLEARANCE CONTROL IMPINGEMENT MANIFOLD AND ENVIRONMENTAL SHIELD

[75] Inventors: Julie A. Ritchie; Joseph H. Schleue; Jeffrey Glover, all of Cincinnati; Frederick W. Tegarden, Glendale, all of Ohio

[73] Assignee: General Electric Company, Cincinnati, Ohio

[21] Appl. No.: 129,936

[22] Filed: Sep. 30, 1993

[51] Int. Cl.[6] ..... F01D 9/02

[52] U.S. Cl. ..... 415/115; 415/116; 415/176; 415/177; 415/178; 165/47

[58] Field of Search ..... 415/115, 116, 136, 138, 415/139, 175, 176, 177, 178, 173.1, 173.2, 173.3; 60/39.75; 165/47

[56] References Cited

U.S. PATENT DOCUMENTS

| | | | |
|---|---|---|---|
| 2,549,819 | 4/1951 | Kane . | |
| 3,641,766 | 2/1972 | Uehling . | |
| 4,017,207 | 4/1977 | Bell et al. . | |
| 4,019,320 | 4/1977 | Redinger, Jr. et al. . | |
| 4,053,254 | 10/1977 | Chaplin et al. . | |
| 4,214,851 | 7/1980 | Tuley et al. . | |
| 4,230,436 | 10/1980 | Davison . | |
| 4,268,221 | 5/1981 | Monsarrat et al. . | |
| 4,279,123 | 7/1981 | Griffin et al. . | |
| 4,329,114 | 5/1982 | Johnston et al. . | |
| 4,525,998 | 7/1985 | Schwarz . | |
| 4,553,901 | 11/1985 | Laurello . | |
| 4,561,246 | 12/1985 | Hovan | 415/176 |
| 4,643,638 | 2/1987 | Laurello . | |
| 4,826,397 | 5/1989 | Shook et al. . | |
| 4,859,142 | 8/1989 | Burke et al. . | |
| 5,100,291 | 3/1992 | Glover | 415/115 |
| 5,273,397 | 12/1993 | Czachar et al. | 415/116 |
| 5,281,085 | 1/1994 | Lenahan et al. | 415/116 |

*Primary Examiner*—Edward K. Look
*Assistant Examiner*—Christopher Verdier
*Attorney, Agent, or Firm*—Nathan D. Herkamp; Jerome C. Squillaro

[57] ABSTRACT

Clearance control is provided by a shaped, integral environmental shield and circumferentially segmented cooling manifold. Each manifold has impingement rails located radially outside selected components of the stator casing. Cooling air is directed onto stator components and returns immediately through circuitous paths to improve uniformity of cooling. The structure incorporates the environmental shield into a two piece bonded structure to facilitate construction and assembly.

14 Claims, 9 Drawing Sheets

INTEGRAL CLEARANCE CONTROL IMPINGEMENT MANIFOLD AND ENVIRONMENTAL SHIELD

BACKGROUND OF THE INVENTION

The invention relates generally to gas turbine engines and, more particularly, to an integral environmental shield and impingement manifold for supplying cooling air to the exterior surface of a casing of a gas turbine engine.

It is understood in the gas turbine art that engine efficiency is improved by minimizing the leakage of hot gases past the turbine. Leakage air does not contribute to the power extracted by the turbine and consequently represents a loss of overall efficiency. Therefore, much effort has been given to limiting clearance between rotor and stator components.

Typically, the prior art has supplied cooling air to gas turbine components to control thermal growth of the turbine casing to minimize the operating clearances. For example, cooling air is supplied to circular spray bars which impinge cooling air upon stator components surrounding a row of turbine blades. Prior art U.S. Pat. No. 4,214,851, issued Jul. 29, 1980, to Tuley, et al., and assigned to the assignee of the present invention, discloses a cooling air manifold of an annular shape with radial holes to supply cooling air to stator components. To further control cooling, the air supply has been controlled as described in, for example, U.S. Pat. No. 4,230,436, issued to Davison and assigned to the assignee of the present invention. In Davison, two sources of air are mixed according to the demand to provide a cooling flow in response to measured engine operating parameters. Another requirement for clearance control for a gas turbine is to shield the turbine stator from air currents of unknown temperature and velocity within the engine nacelle from impinging directly on the stator casing, because such air could create a "cold spot" which would cause distortion of the casing, thereby adversely affecting clearance control.

An improved turbine casing cooling manifold is disclosed in U.S. Pat. No. 5,100,291, issued Mar. 31, 1992, to Jeffrey Glover, and assigned to the assignee of the present invention. That patent discloses apparatus to spray cooling air over flanges of a gas turbine stator structure through arcuate segment tubes disposed around a gas turbine stator to apply uniform cooling to the stator components. A cooling pattern is selected to provide optimum cooling, and a baffled construction is used to reduce distortion due to external influence on the stator. The baffled construction also provides controlled passage of spent impingement air out of the turbine. A separate environmental shield was provided to isolate the stator from the external environment. This construction enhanced uniformity of cooling around the circumference of the turbine casing.

SUMMARY OF THE INVENTION

The present invention provides an environmental shield integral with a cooling manifold designed to allow delivery of cooling air to be tailored to a specific stator component.

BRIEF DESCRIPTION OF THE DRAWINGS

The present invention is illustrated by way of detailed example in the Figures of the accompanying drawing in which like reference numerals refer to like elements throughout, and in which.

DESCRIPTION OF THE PREFERRED EMBODIMENTS

"Inner" is used herein to identify a surface of a component facing radially toward the axis of rotation of a turbine rotor and "outer" is used herein to identify a surface of a component facing radially away from the axis of rotation of the rotor.

Figure 1:
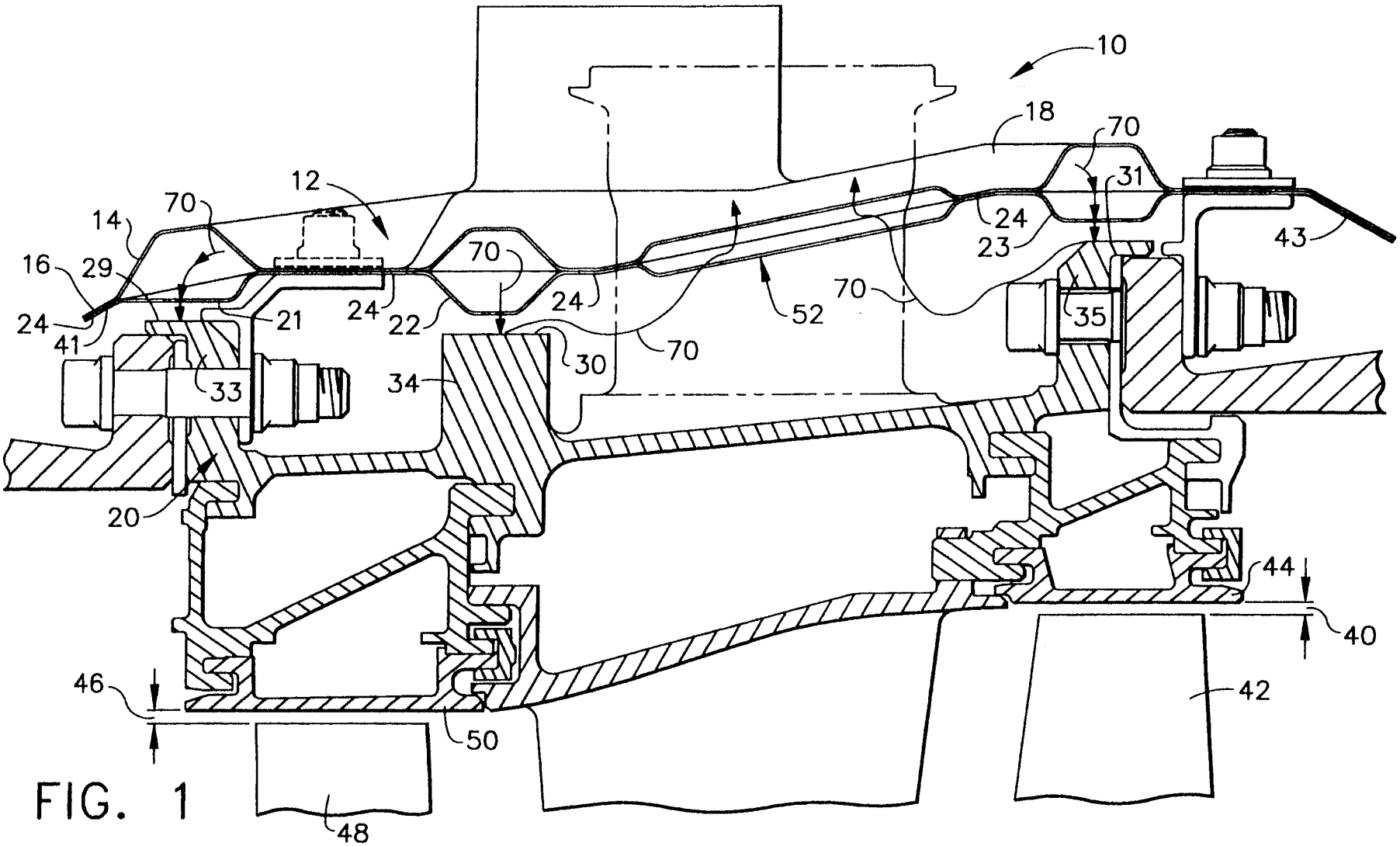
FIG. 1 is a schematic cross-sectional view of a cooling manifold arrangement incorporating the present invention.
Figure 2:
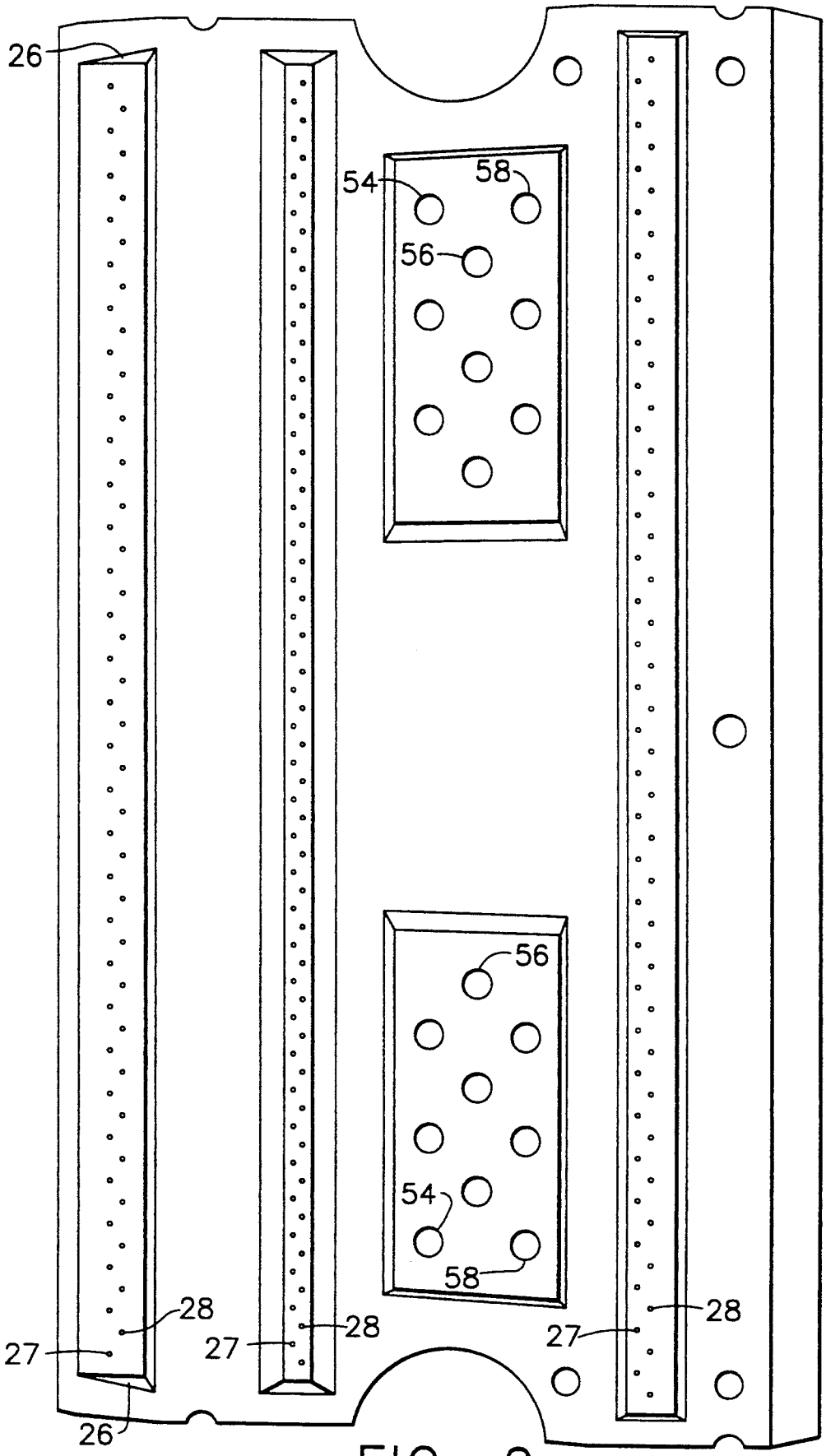
FIG. 2 is a schematic partial plan view illustrating the radially inner surface of the cooling manifold of FIG. 1.
Figure 3:
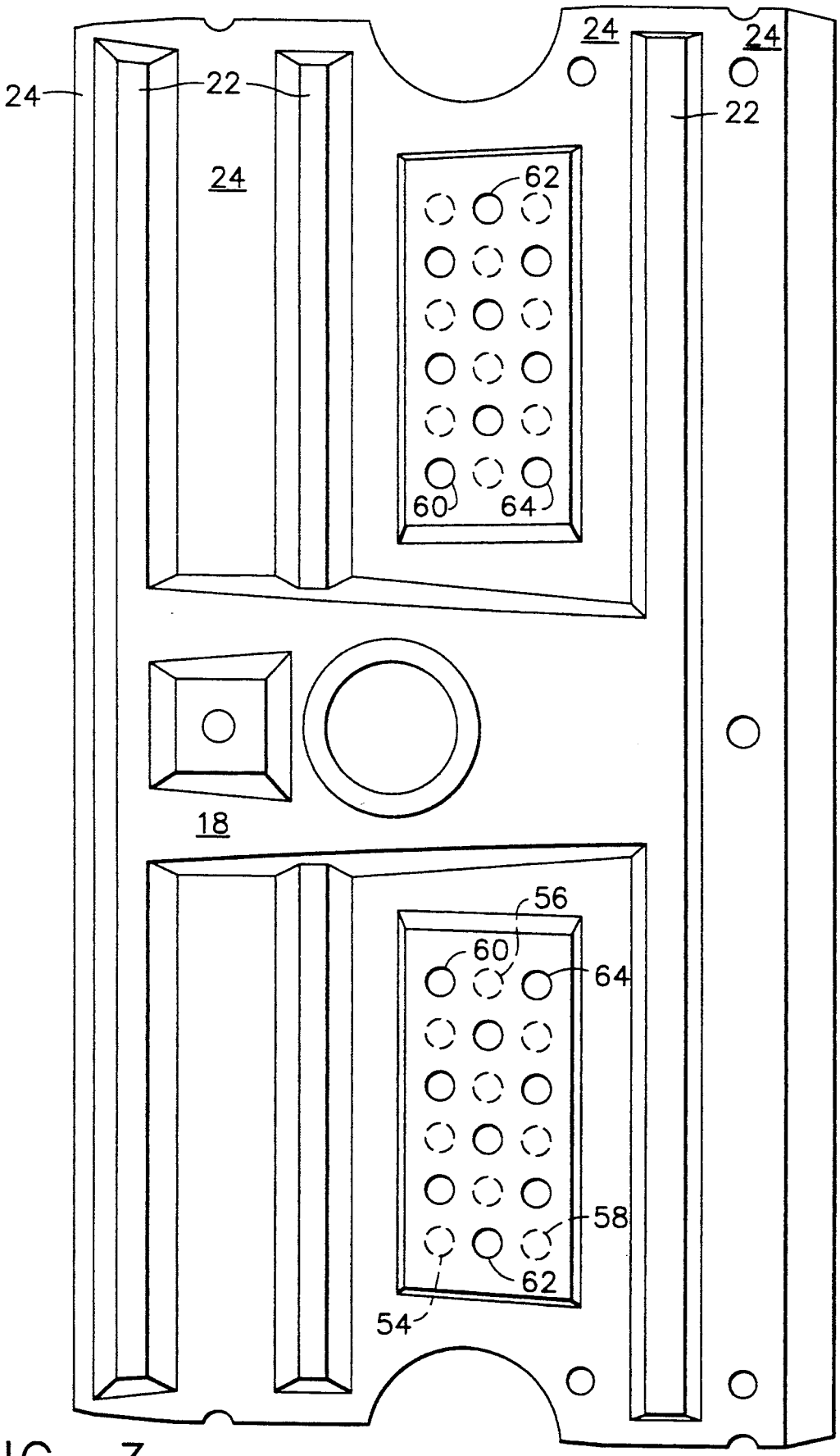
FIG. 3 is a schematic partial plan view illustrating the radially outer surface of the cooling manifold of FIG. 1.

In the cooling system 10 of the present invention, shown in FIGS. 1, 2 and 3 an integral environmental shield and arcuate manifold segment 12 is formed of an outer sheet 14 and an inner sheet 16 of suitable metal shaped by a process such as super plastic forming and bonded together by welding, diffusion bonding or other suitable bonding technique to form a plurality of hollow, shaped passageways surrounded by sealed areas. As shown in FIGS. 1, 2 and 3, a plurality of hollow impingement rails 21, 22, 23 and baffle sections 52 separated by bonded sections 24 are provided in the manifold segment 12. In order to cool a stator uniformly a plurality of manifold segments are arranged in circumferentially abutting relationship to provide a cooling "ring" surrounding the stator 20. A header 18 is connected to at least one, and in the preferred arrangement shown to each, of the impingement rails of a respective manifold segment.

Each impingement rail is closed at its respective ends 26 as shown in FIG. 2. Each header 18 is connected at about the middle of the arc of impingement rails 21, 22, 23 so that the total circumferential travel of the cooling air within each impingement rail is about half the arcuate angle subtended by each rail. Each of the impingement rails 21, 22, 23 is shaped to optimize the cooling effect of air supplied through rows of openings 27, 28 through the inner wall 16 thereof to spray cooling air on stator components disposed radially inward from the respective rows of openings 27, 28, such as surfaces 29, 30, 31 of flanges 33, 34, 35, respectively. As shown in FIG. 1, rail 21 is generally triangularly shaped, rail 22 is generally trapezoidal and rail 23 is generally trapezoidal with longer bases and a lower height than those of rail 22. Tailoring of impingement rails by, for example, using a wider rail to complement a wide flange and a narrower rail for a narrower flange and selecting particular cooling passage patterns through each impingement rail creates a manifold capable of applying precisely the required amount of cooling air to each component of the stator opposite one of the rails to control its thermal growth during operation of the gas turbine of which the manifold is a part. Precise control of thermal growth is critical to precise control of engine clearances as the gap 40 between rotor blade 42 and stator ring 44 and the gap 46 between blade 48 and ring 50. Tailored cooling is a significant improvement over the prior art manifolds which used circular tubes which limit the application of cooling air to only very limited angles over limited areas.

The manifold 12 also includes baffle sections 52 for exhausting spent cooling air from the region adjacent the stator casing. Each baffle section 52 includes openings 54, 56, and 58 through the inner wall 16, as shown in FIG. 2, and openings 60, 62, 64 through the outer wall 14, as shown in FIG. 3, to baffle exhaust flow of spent cooling air from the region of flanges 33, 34, 35. Each of the baffle sections is arranged such that air exiting from the manifold follows a short but indirect path. For example, openings 54, 56, 58 are positioned as shown in phantom in FIG. 3, so that they are offset from openings 60, 62, 64. The baffle arrangement provides immediate exit for spent impingement air which prevents cross flow interference with impingement patterns on adjacent flanges; prevents air currents in the external environment, such as, air currents from leaky pipes, from directly impinging on the turbine case; and prevents entrainment of external environmental air into the impingement jets. Such air from, for example, an aircraft engine bay, would be of unknown temperature and flow rate, and would adversely affect uniformity of cooling and therefore the accuracy of clearance control. The entire perimeter of the manifold segment 12 is sealed by bonded sections 24 to prevent leakage of the air flow from the impingement rails or baffles. Outer sheet 14 and inner sheet 16 also extend beyond the impingement rails to provide an environmental shield with end skirts 41, 43 integral with the manifold structure. The environmental shield limits transfer of heat from the high pressure turbine casing to the components of the manifold external to the inner sheet 16 and prevents the creation of "cold spots" by impingement of air from the exterior of the manifold onto the stator casing.

The cooling air circulates to cool the stator components as follows. Cooling air is bled from the fan or booster section of the gas turbine engine and supplied via a supply system to the headers 18. Typically, valves are used to control the amount of overall cooling air flow to the headers. The air flow and the air temperature determine the heat transfer capacity available to accomplish the required cooling. Air flows, as shown by arrow 70 in FIG. 1, through each of the respective tube segments 22. Air exits the openings 27, 28 of the respective impingement rails 21, 22, 23 to impinge on surfaces 29, 30, 31 of respective stator casing flanges 33, 34, 35. Spent cooling air passes via return flow passages 54, 56, 58, of the baffle sections and exits via holes 60, 62, and 64 into the area external to the cooling manifold. Thus, the manifold 12 of the present invention provides impingement rails, baffled exhaust passages for spent cooling air, and an environmental shield as a single integral structure. No assembly of multiple components is required, thereby greatly simplifying attachment and/or removal of the integral shield/manifold during engine assembly and/or maintenance. The number of special tools and fixtures required is reduced by the use of a single integral structure as described herein, rather than the multiple part assembly of the prior art. Additionally, the present invention minimizes the amount of air which must be expended to cool the stator by providing the capability to tailor the cooling air supply to that required for cooling the specific parts. Therefore the present invention significantly enhances engine efficiency by accurately controlling clearances in a gas turbine with a minimum penalty of compressor bleed air.

Figure 4:
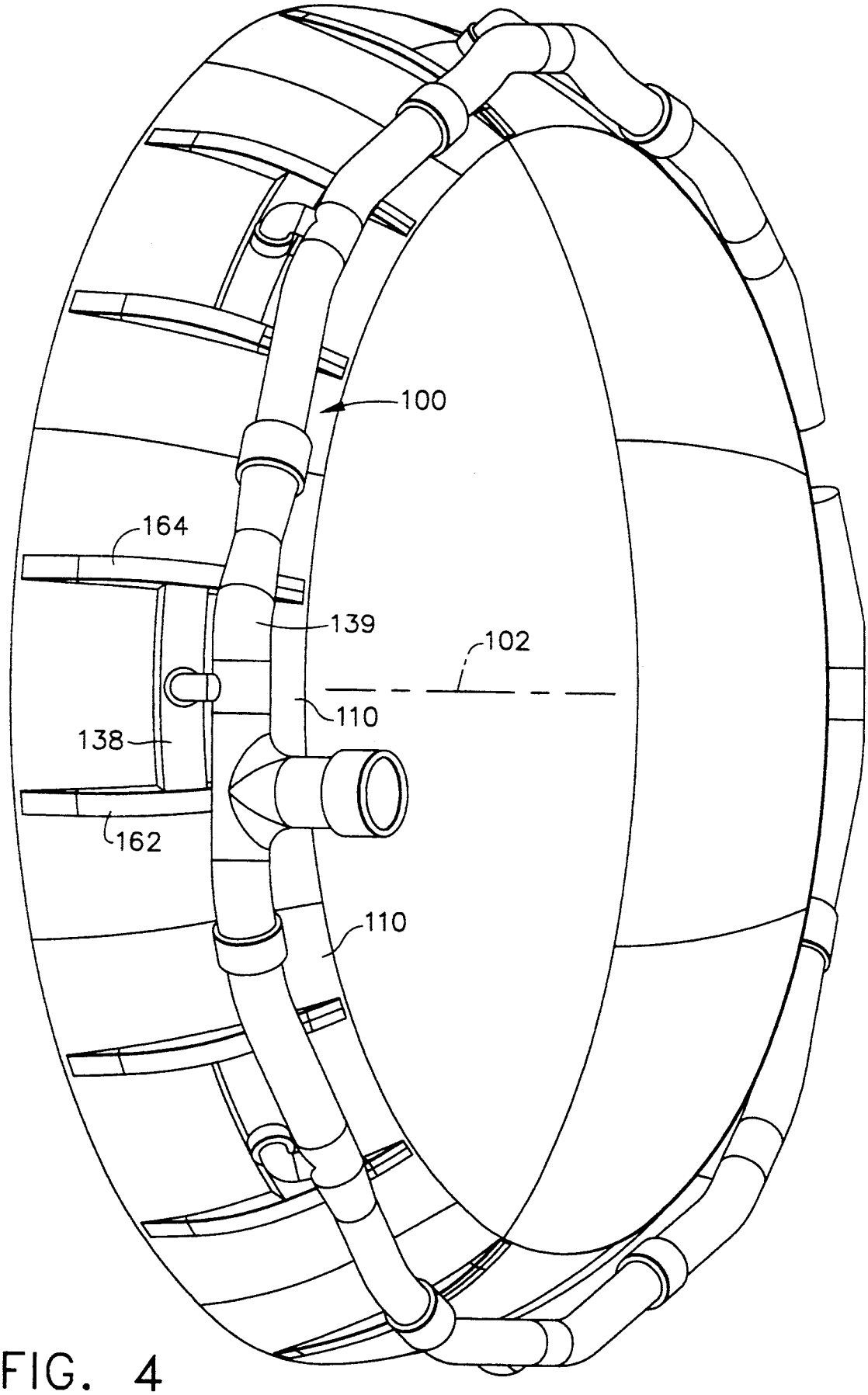
FIG. 4 is a schematic isometric view of an alternative cooling manifold arrangement built according to the present invention for use on a low pressure turbine of a gas turbine engine.
Figure 5:
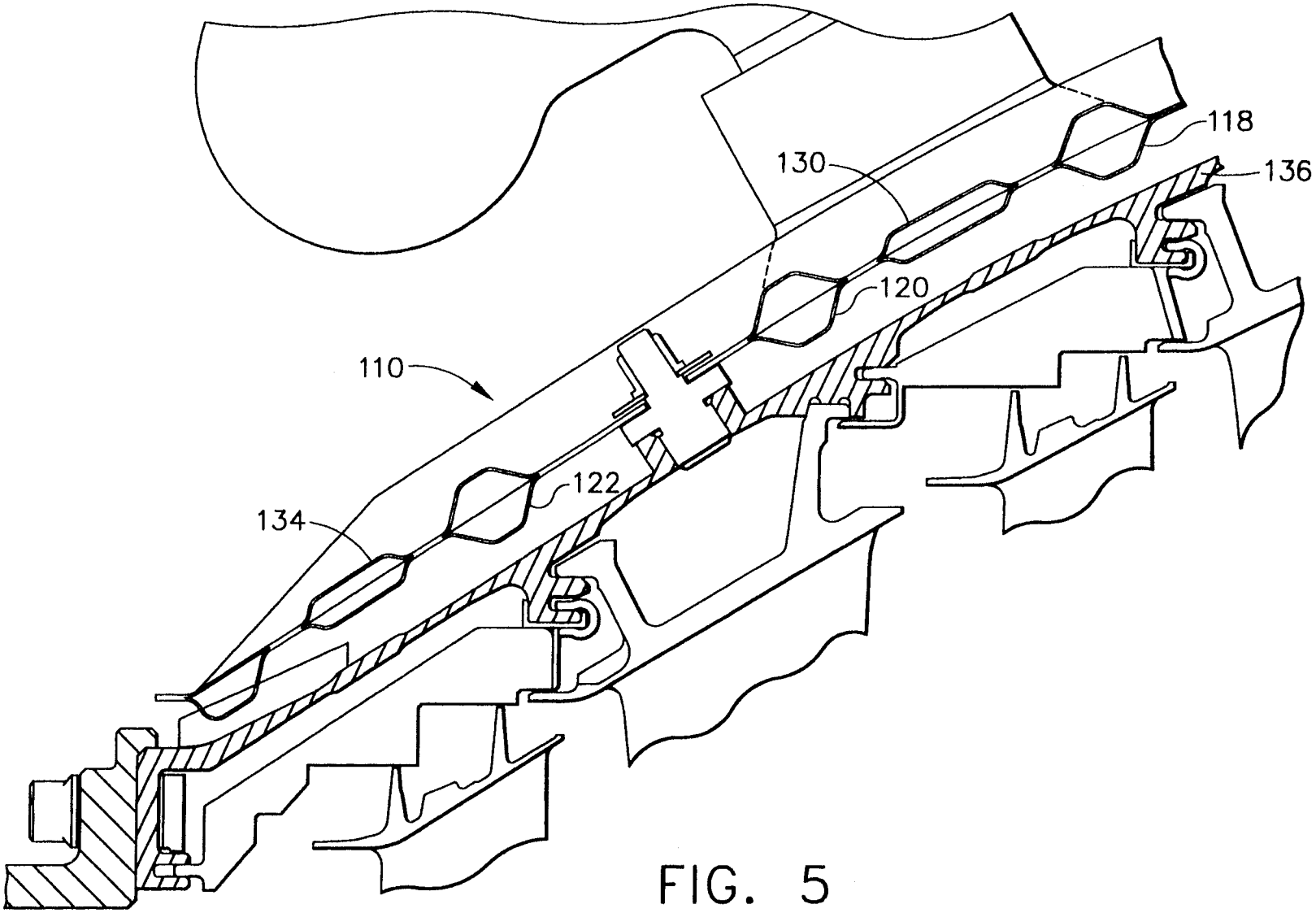
FIGS. 5 and 5A are a schematic partial cross-sectional view of a cooling manifold of FIG. 4.
Figure 6:
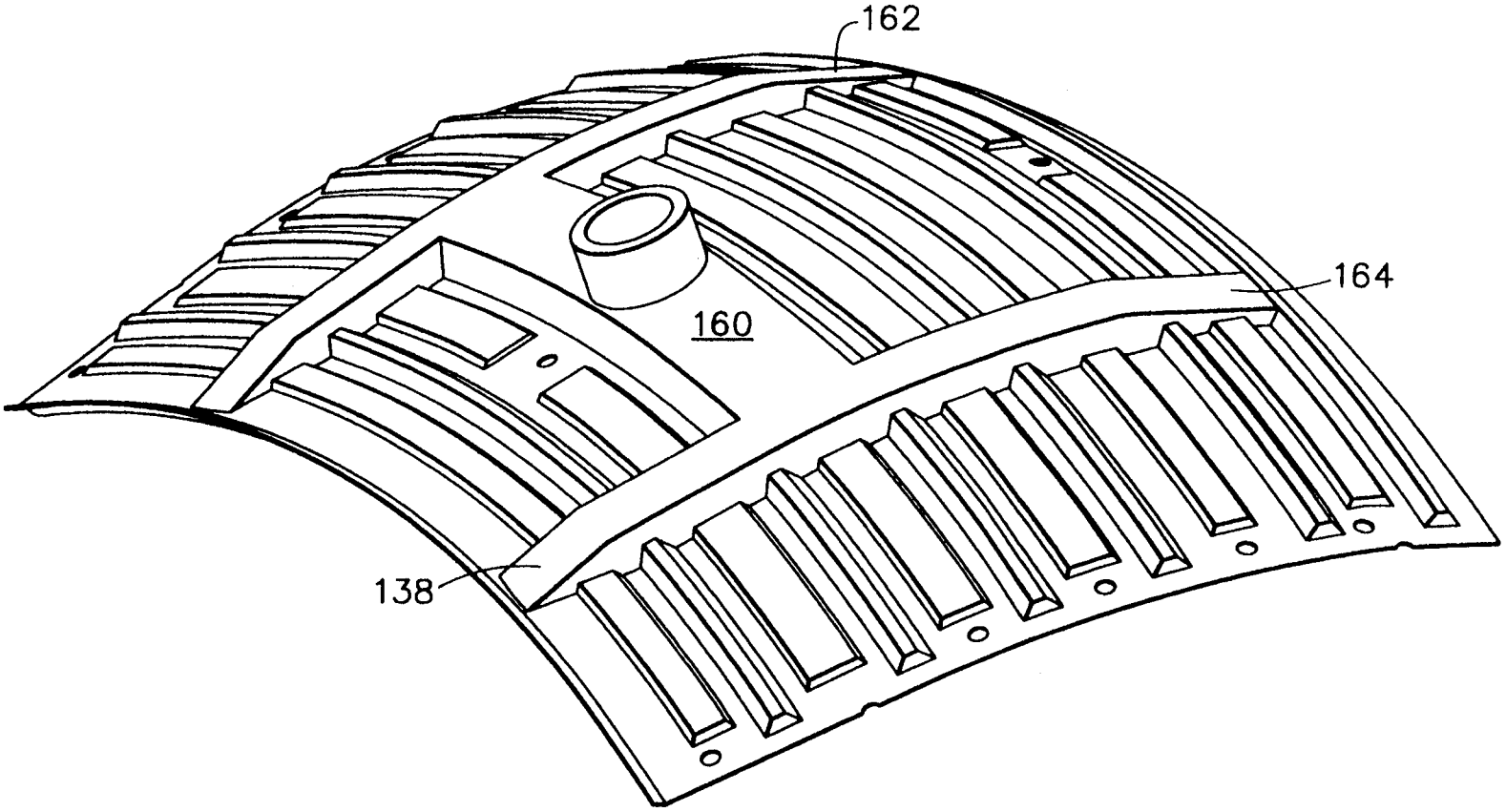
FIG. 6 is a schematic perspective view illustrating the radially outer surface of a cooling manifold shown in FIGS. 5 and 5A.
Figure 7:
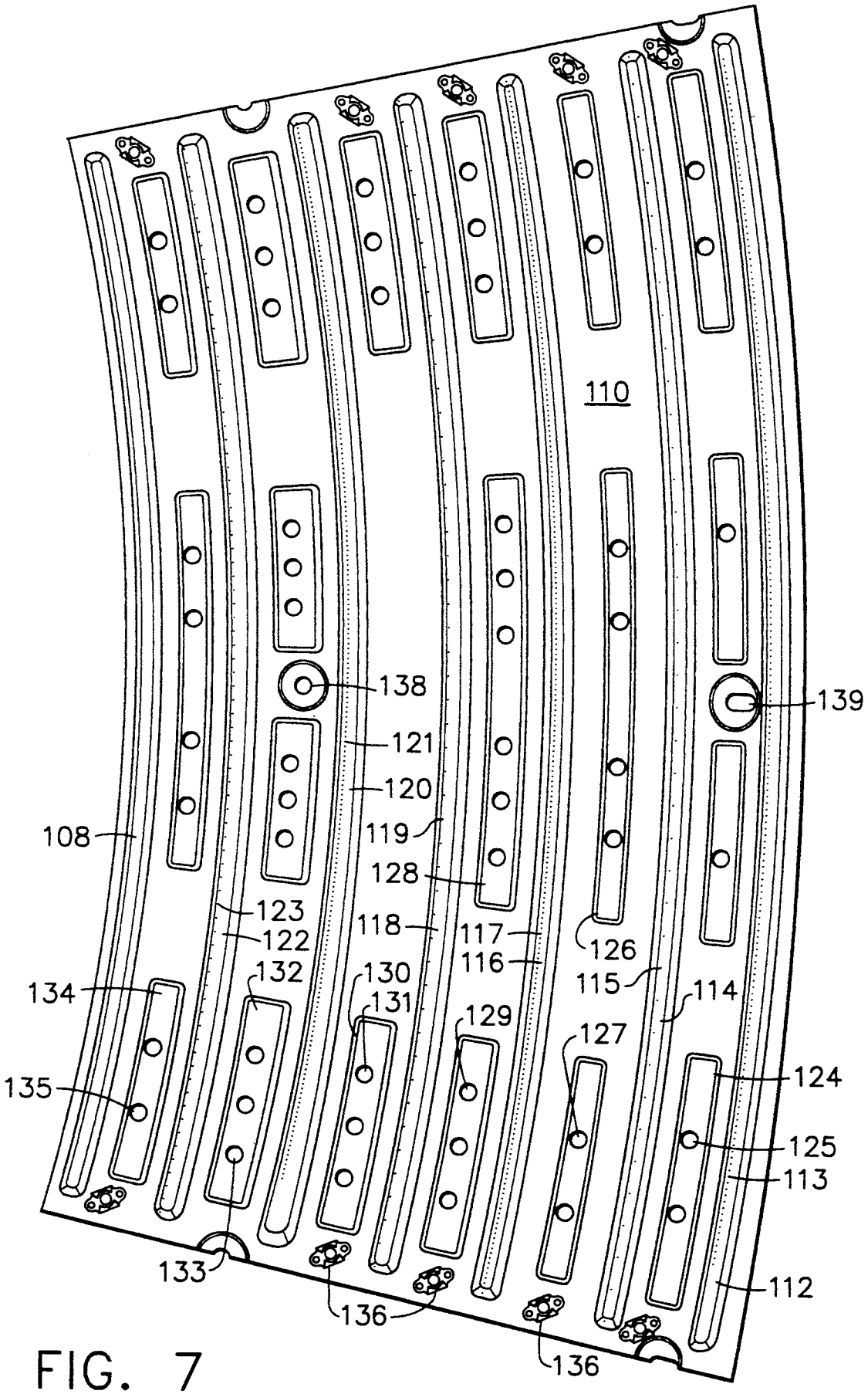
FIG. 7 is a schematic plan view illustrating the radially inner surface of a cooling manifold shown in FIGS. 5 and 5A.

FIG. 4 schematically illustrates an environmental shield and manifold 100 built according to the present invention and centered around the axis 102 of rotation of a low pressure turbine of a gas turbine engine. A plurality of manifold segments 110 of the type shown in FIGS. 5–7 are arranged in circumferentially abutting relationship to provide a cooling "ring". Each header 138 is attached to the distribution feed pipe 139 to form a complete ring around a structure to be cooled.

Figure 5A:
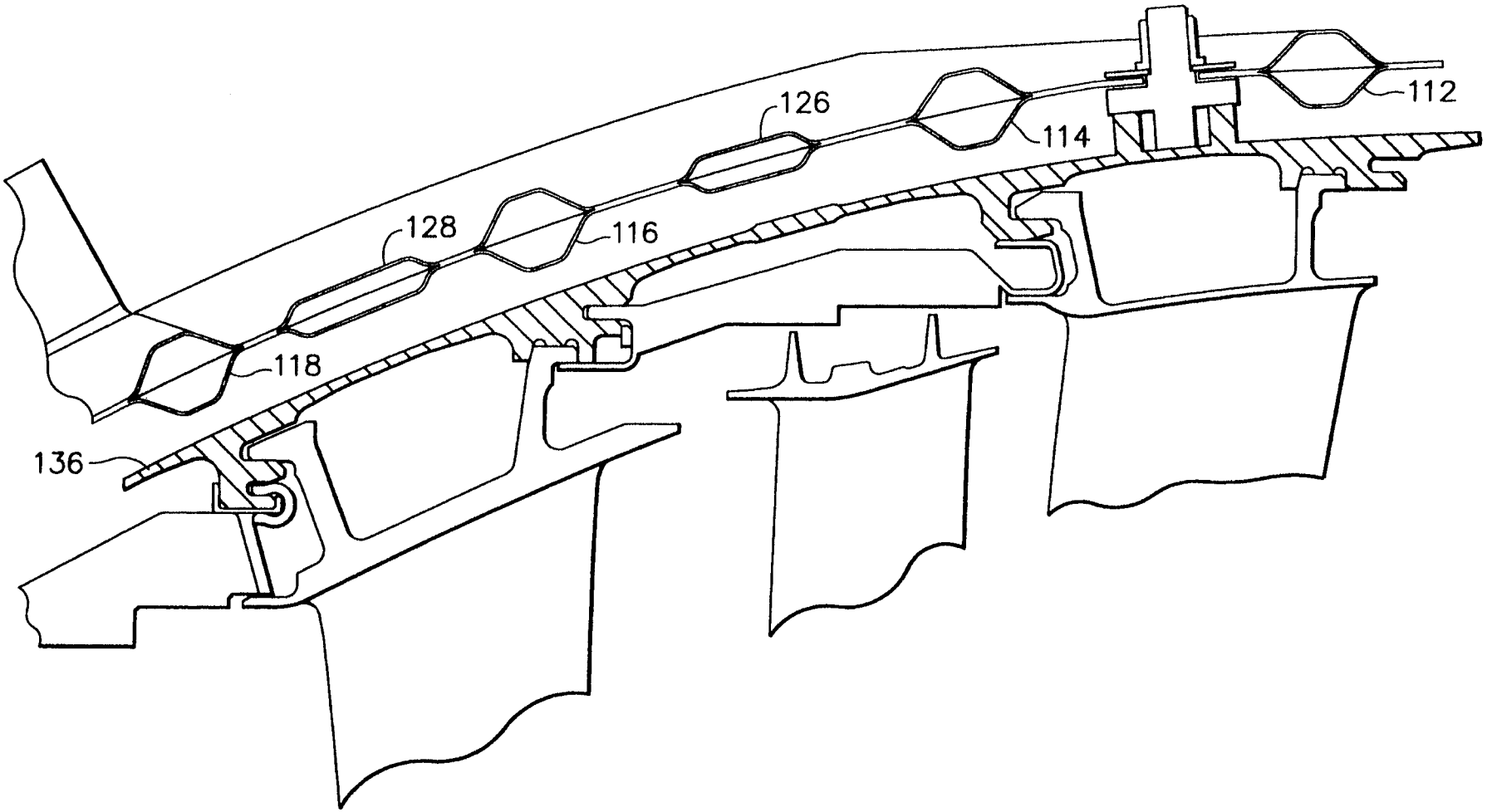

As shown in FIGS. 5 and 5A, each manifold segment 110 comprises a pair of sheets of metallic material formed to include a plurality of cooling air impingement rails 112, 114, 116, 118, 120 and 122 and a plurality of exhaust baffles 126, 128, 130, 132 and 134. Cooling airflow is provided to those areas of the surface of the casing 136 in the required pattern to cool the locations radially inside the impingement rails to apply the desired cooling to specific flanges or other elements of the casing 136. Spent cooling air is exhausted through the exhaust baffles 126, 128, 130, 132 and 134.

FIG. 6 illustrates a header 138 for supplying cooling air to the manifold segments 110. The header includes a generally circumferentially extending tube 160 and two generally axially extending tubes 162 and 164. The H-shaped header 138 provides input to the cooling air impingement rails at a position approximately one-fourth the circumferential length of each rail from the end of the rails. This effectively reduces the circumferential travel of cooling air to minimize heat pick up from the casing prior to impingement of the cooling air onto the stator casing. This enhances uniformity of the temperature of the cooling air impinges on the casing to maintain uniformity of thermal growth of stator components and enhance accuracy of clearance control. More accurate control allows use of narrower clearances which results in less leakage of gas past the turbine blades, thereby reducing losses.

As shown in FIG. 7, the inner surface of a manifold 110 of the present invention includes a plurality of distribution tubes 112, 114, 116, 118, 120, 122, and a plurality of rows 124, 126, 128, 130, 132, 134 of baffles separated by sealed portions of the two sheet structure. The hole pattern in each distribution tube is selected to provide a tailored cooling flow to a specific portion of the stator casing required to cool that portion. Specifically, the spacing of cooling holes 113 is selected to provide a predetermined flow rate of cooling air. The spacing of cooling holes 115 is much larger than the spacing of holes 113 to provide a lesser cooling flow rate. Cooling holes 117 and 121 are spaced approximately one hole diameter apart to provide a flow rate greater than that of the other rows, while the holes 119 and 123 are spaced several hole diameters apart to provide a lesser cooling air flow rate. By selecting cooling hole spacing, the flow rate may be tailored for a given air supply pressure and temperature to provide that flow needed to cool a flange or other stator component to match the heat removal required to maintain uniform clearance in engine components and to maintain the stator components in a very precise circular shape. The blind rail 108 is provided to enhance stiffness of the edge of the shield where no impingement cooling is required. The holes 125, 127, 129, 131, 133, and 135 are spaced to provide the necessary return flow for spent cooling air. The number and spacing of these holes may also be selected to accommodate increased or decreased flow. The segments may be attached to adjacent segments by any of a variety of fasteners 136. Mounting holes 138, 139 may be provided for attachment of the manifold to the engine structure, and the elongated hole 139 allows for thermal growth relative to the external structure.

Figure 8:
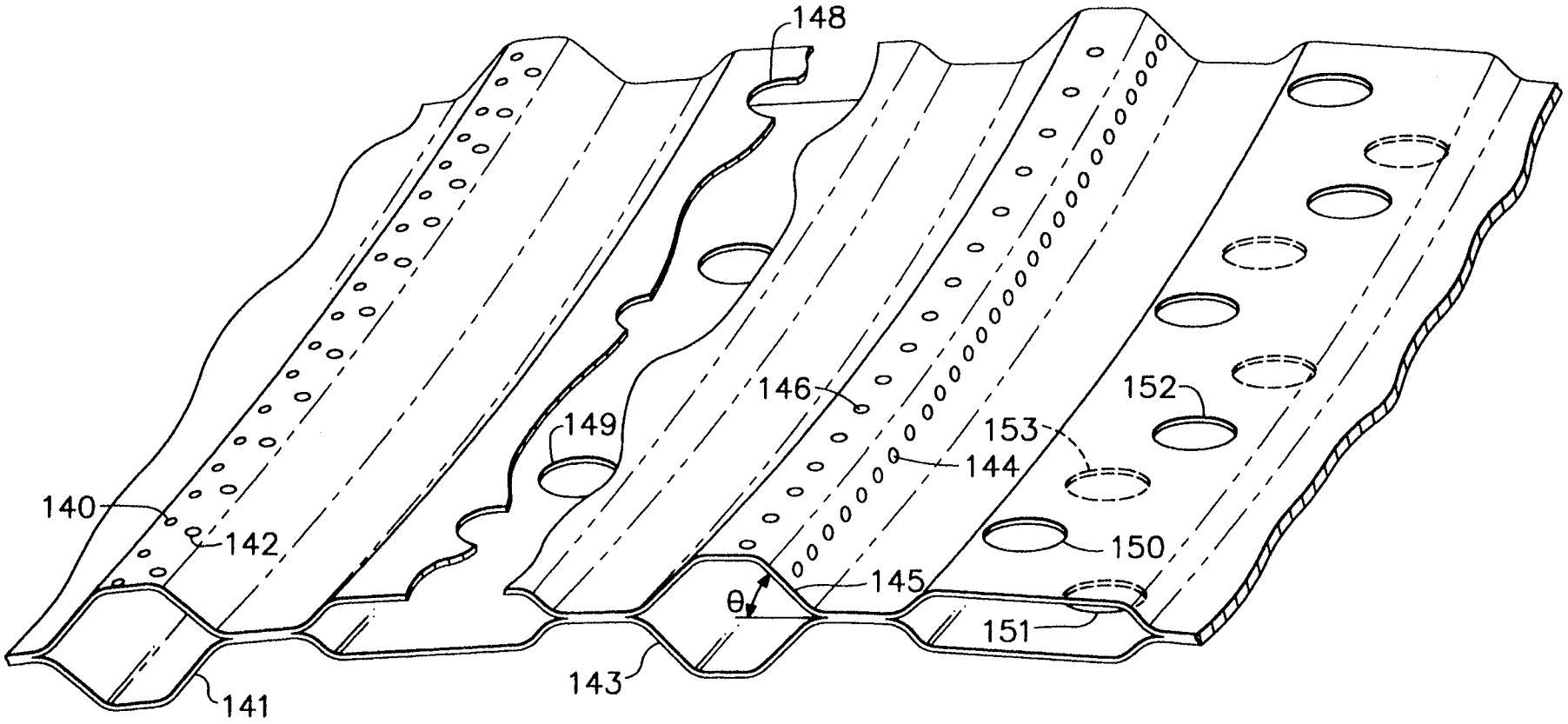
FIG. 8 is a partial schematic plan view of an alternative embodiment of the cooling manifold of the present invention.

FIG. 8 illustrates another alternative arrangement for a manifold according to the present invention. As shown in FIG. 8, rail 141 includes two rows of holes 140, 142 having different diameters. Impingement rail 143 has one row of holes 144 cut through surface 145 at an angle $\theta$ to the axis of the stator to direct flow in a particular direction toward a surface to be cooled. A second row of holes 146 through rail 143 supplies cooling air flow in the generally radial direction. Exhaust holes 148 for return flow are offset from the row of exit holes 149. Similarly, each of the rows of exhaust holes 150, 152 is offset from the rows of exit holes 151, 153, respectively, so that no direct path exists for air or thermal radiation to travel between the stator casing 136 and parts external to the manifold.

It will be understood that many modifications and combinations may be made by one skilled in the art without departing from the scope of the invention as described herein. For example, many variations of impingement rail surface shape and cooling hole configuration or exhaust hole configuration may be used to match cooling air supply to the heat transfer required for any particular thermal control requirement. Additionally, the perimeters of the manifold segments may be extended as required to create an environmental shield sufficient to block direct thermal contact between the stator casing and the external environment.

What is claimed as novel and desired to be secured by Letters Patent of the United States is:

1. An integral environmental shield and impingement manifold for a gas turbine engine comprising:

a plurality of arcuate manifold segments connected in generally circumferentially abutting relationship to form a generally annular manifold centered around an axis thereof, wherein each said manifold segment comprises:

a first sheet of formed metallic material;

a second sheet of formed metallic material bonded in face to face relationship to said first sheet at predetermined locations to provide a pattern of generally hollow passages between said first and second sheets surrounded by bonded areas of said sheets; and wherein said hollow passages include;

at least one generally circumferentially extending hollow, arcuate impingement rail having a plurality of impingement passages through the radially inner one of said sheets for supplying cooling air onto a generally circular surface of an object disposed adjacent and radially inside said impingement rail; and at least one generally circumferentially extending, hollow baffle section having a first set of exhaust passages through said radially inner one of said sheets and a second set of exhaust passages through said second one of said sheets offset from said first set of exhaust passages.

2. The invention of claim 1 wherein:

said sheets extend axially and circumferentially to provide environmental shield skirts for shielding said object from direct contact with the environment radially outside said manifold.

3. The invention of claim 1 further comprising:

a header in flow communication with each said impingement rail for supplying cooling air flow to approximately the circumferential center of each said impingement rail.

4. The invention of claim 1 wherein:

said object comprises a stator casing of a gas turbine engine;

said first sheet comprises a sheet of metallic material formed into a complex shape complementary to the shape of predetermined parts of said stator casing of said gas turbine; and said second sheet comprises a sheet of metallic material formed to complement the shape of said first sheet.

5. The invention of claim 4 wherein:

said plurality of impingement passages comprises a plurality of rows of cooling holes through said radially inner sheet at preselected positions to apply a predetermined cooling airflow to said circular surface of said stator casing;

said first set of exhaust passages comprises a plurality of rows of exhaust passages through said first sheet; and said second set of exhaust passages comprises a plurality of rows of exhaust passages through said second sheet.

6. The invention of claim 4 wherein said hollow passages comprise;

a plurality of elongated generally circumferentially extending hollow, arcuate impingement rails; wherein at least a first one of said impingement rails is of a generally triangular cross section having a plurality of impingement passages through the radially inner side of said triangular shape for supplying cooling air onto a first generally circular surface of said stator casing disposed adjacent and radially inside said first one of said impingement rails; and at least a second one of said impingement rails is of a generally trapezoidal cross section having a plurality of impingement passages through a radially inner base side of said trapezoidal shape for supplying cooling air onto a second generally circular surface of said stator casing disposed adjacent and radially inside said second one of said impingement rails; and a plurality of generally circumferentially extending, hollow baffle sections each having a first set of exhaust passages through said radially inner one of said sheets and a second set of exhaust passages through said second one of said sheets offset from said first set of exhaust passages.

7. The invention of claim 6 further comprising:

an H-shaped header having a pair of generally axially extending distribution tubes in flow communication with each said impingement rail for supplying cooling air flow thereto at positions spaced from the respective ends of each respective impingement rail approximately one quarter of the circumferential length of each said respective impingement rail.

8. The invention of claim 6 wherein:

each said plurality of impingement passages comprises a plurality of rows of cooling holes through said first sheet at preselected positions to apply a predetermined cooling airflow to said circular surfaces of said stator casing;

each said first set of exhaust passages comprises a plurality of rows of exhaust passages through said first sheet; and each said second set of exhaust passages comprises a plurality of rows of exhaust passages through said second sheet.

9. The invention of claim 6 wherein:

a first one of said plurality of impingement passages comprises a plurality of rows of cooling holes through said first sheet at a first preselected spacing to apply a predetermined cooling airflow to a first one of said circular surfaces of said stator casing;

a second one of said plurality of impingement passages comprises a row of cooling holes through said first sheet at a second preselected spacing to apply a predetermined cooling airflow to a second one of said circular surfaces of said stator casing;

each said first set of exhaust passages comprises a plurality of rows of exhaust passages through said first sheet; and each said second set of exhaust passages comprises a plurality of rows of exhaust passages through said second sheet.

10. An integral environmental shield and impingement manifold comprising:

a first sheet of formed material;

a second sheet of formed material bonded in face to face relationship to said first sheet at predetermined locations to provide a pattern of facing unbonded areas of said sheets surrounded and sealed by bonded areas; and wherein said unbonded areas include:

at least one elongated hollow impingement rail having a plurality of impingement passages through one of said sheets for supplying cooling air to an object disposed adjacent said impingement rail; and at least one hollow elongated baffle section having a first set of exhaust passages through said one of said sheets and a second set of exhaust passages through said second one of said sheets offset from said first set of exhaust passages.

11. The invention of claim 10 further comprising:

skirts formed at the perimeter of said sheets extending beyond the perimeter of the impingement rails and baffle sections to provide an enlarged environmental shield for shielding said object from direct contact with the environment on the side of said manifold opposite said object.

12. The invention of claim 10 further comprising:

a header in flow communication with each said impingement rail for supplying cooling air flow to approximately the circumferential center of each said impingement rail.

13. The invention of claim 10 wherein:

said first sheet comprises a sheet of metallic material having a complex shape complementary to the shape of a part of said object to be cooled; and said second sheet comprises a sheet of metallic material formed to complement the shape of said first sheet.

14. The invention of claim 13 wherein:

said plurality of impingement passages comprises a plurality of rows of cooling holes through said first sheet at preselected positions to apply a predetermined cooling airflow to preselected elements of said object;

said first set of exhaust passages comprises a plurality of rows of exhaust passages through said first sheet; and said second set of exhaust passages comprises a plurality of rows of exhaust passages through said second sheet.

* * * * *